United States Patent [19]

Ramachandran et al.

[11] Patent Number: 4,707,289

[45] Date of Patent: Nov. 17, 1987

[54] ALPHA-SULFO-FATTY ACID ESTER AND/OR AMIDE SALT(S) DETERGENT LAUNDRY BARS AND PROCESSES FOR MANUFACTURE THEREOF

[75] Inventors: Pallassana N. Ramachandran, Robbinsville; Patrizia Barone, Piscataway, both of N.J.

[73] Assignee: Colgate Palmolive Company, New York, N.Y.

[21] Appl. No.: 836,910

[22] Filed: Mar. 6, 1986

[51] Int. Cl.[4] ..... C11D 17/00

[52] U.S. Cl. ..... 252/135; 252/134; 252/140; 252/174; 252/174.14; 252/174.25; 252/531; 252/532; 252/545; 252/550; 252/551

[58] Field of Search ..... 252/134, 135, 531, 139, 252/140, 154, 163, 174, 174.25, DIG. 16, 530, 532, 535, 538, 545, 549, 551, 553, 557

[56] References Cited

U.S. PATENT DOCUMENTS

| | | | |
|---|---|---|---|
| 3,442,812 | 5/1969 | Barnhurst et al. | 252/535 |
| 4,011,170 | 3/1977 | Pickin et al. | 252/134 |
| 4,265,778 | 5/1981 | Sonenstein | 252/DIG. 16 |
| 4,472,287 | 9/1984 | Ramachandran et al. | 252/174.25 |
| 4,515,707 | 5/1985 | Brooks | 252/531 |
| 4,543,204 | 9/1985 | Gervasio | 252/DIG. 16 |

*Primary Examiner*—Paul Lieberman
*Assistant Examiner*—Hoa Van Le
*Attorney, Agent, or Firm*—Herbert S. Syvester; Murray M. Grill; John A. Stemwedel

[57] ABSTRACT

Detergent laundry bars of acceptable mildness, detergency, foaming properties, processing characteristics and resistance to breakage are described which are based on built water soluble salts of alpha-sulfo-higher fatty acid-lower alcohol ester detergent and/or alpha-sulfo-higher fatty acid-amide, and which contain bentonite, which acts as a bodying agent for the laundry bars, facilitating production thereof, and contributing fabric softening properties to laundry washed with such laundry bars. When the bentonite is omitted or is replaced by water insoluble filler, such as calcium carbonate powder, and the alpha-sulfo-fatty acid derivative detergent is employed as an aqueous solution, bars made are not of acceptable hardness and such compositions are not satisfactorily processable in conventional soap-making apparatuses.

Also described are processes for converting aqueous solutions of alpha-sulfo-fatty acid derivative detergent to solid form by treatment with bentonite, and for making detergent laundry bars from such solidified detergent.

19 Claims, No Drawings

ALPHA-SULFO-FATTY ACID ESTER AND/OR AMIDE SALT(S) DETERGENT LAUNDRY BARS AND PROCESSES FOR MANUFACTURE THEREOF

This invention relates to detergent laundry bars. More particularly, it relates to a built synthetic organic detergent laundry bar in which the detergent is primarily water soluble alpha-sulfo-higher fatty acid ester of lower alcohol or water soluble alpha-sulfo-higher fatty amide, or a mixture of such detergents. Such bars, containing such detergent(s), builder, bentonite and water, are superior in important characteristics to bars of the same formula except for the replacement of the bentonite with other water insoluble fillers or bodying agents, such as calcium carbonate powder. Such characteristics in which the invented bars are superior include processing ease, bar hardness and fabric softening. The bars made are also of satisfactory foaming and detergent properties for hand washing laundry, and are acceptably mild to the skin of the user. They are resistant to cracking, chipping, breakage or other damage on storage and handling, unlike bars of the same formula except for the replacement of the water soouble alpha-sulfo-fatty acid ester or amide salt detergent with other synthetic organic detergent, such as sodium higher fatty alcohol sulfate. Processing of the alpha-sulfo-fatty acid ester and/or amide salt is facilitated by forming a solid or semi-solid composition of the aqueous detergent solution or solution/dispersion (in which form it is usually supplied) with bentonite, and then amalgamating the resulting product with other detergent composition components before plodding the composition to bar form.

Soap bars have for long been employed for washing the human body and for "doing laundry". Before the advent of washing machines promoted the employment of detersive materials in powder, disintegrable briquette, particulate, packet, sheet and liquid forms, laundry was washed with 'laundry soap' bars made from suitable soaps of higher fatty acids, such as sodium soaps of mixed tallow and rosin fatty acids. Such laundry soap bars were especially suitable for being rubbed onto badly stained or soiled portions of fabric being laundered, as on a washboard, to deposit a high concentration of the soap on the soiled area, and they provided mechanical means for applying energy to such surfaces to assist in removing stains and soils.

Despite the fact that after introduction of synthetic organic detergents and washing machines the amount of soap employed for laundry use diminished greatly, with soap-based laundry bars being replaced mostly by synthetic organic detergent compositions in powder, liquid or other suitable form, laundry soaps and detergents in bar form are still preferred by some consumers in certain areas of the world, especially where washing machines are not employed by most of the people. Several detergent laundry bars based on alkylbenzene sulfonate detergents have been successfully marketed. They have been characterized as the equivalents in washing abilities of powdered laundry detergents based on similar alkylbenzene sulfonates, and are considered by many consumers to be more convenient to use. To use them does not require a washing machine and, as was previously indicated, the bar form of the product allows it to be used in such manner that a comparatively high concentration of detersive material may be readily applied to a heavily stained or soiled area with accompanying physical force or energy, as on a washboard, so as more readily to loosen and remove such soil or stain.

Although water soluble salts of higher alkylbenzene sulfonic acids, such as sodium dodecylbenzene sulfonate (the dodecyl is often highly branched propylene tetramer but can be linear too), make satisfactory detergent laundry bars, such detergents have sometimes been found to be environmentally, ecologically, or economically unacceptable, and accordingly, efforts have been made to formulate detergent laundry bars based on other synthetic organic detergents which would be unobjectionable or less objectionable in such respects. Among candidates for use as such a detergent are the higher fatty alcohol (or alkyl) sulfates, especially the sodium salts, which are biodegradable and have been successfully employed in various detergent compositions. However, such higher fatty sulfate bars have been found to be susceptible to being damaged during handling after storage and before final use. It was observed that they appeared to change physical properties after manufacture and became prone to excessive breakage during ordinary shipment. Additionally, such products were often not of satisfactory foaming properties. One solution to breakage problems is disclosed in U.S. Pat. No. 4,543,204, which teaches the incorporation of higher fatty acid in the bar formula to counteract the tendency of higher fatty alcohol sulfate laundry bars to crack or break during storage and shipment, and also mentions that the fatty acid improves foaming characteristics of the fatty alcohol sulfate bars. However, that requires the addition of material to the formula which is not a detergent or a builder, and which may be comparatively expensive. The present invention is of a detergent laundry bar of acceptable laundry bar properties (foaming, cleaning, scum dispersing, processing ease, and mildness), which is environmentally acceptable (biodegradable), and which does not crack or break to an excessive extent on storage and during shipment. The invention is also of a process of making such laundry bars from an aqueous solution or solution/dispersion o alpha-sulfo-higher fatty compound, builder and bentonite, in which the bentonite makes the aqueous detergent processable.

In accordance with the present invention a built synthetic organic detergent laundry bar comprises 10 to 40% of water soluble salt of alpha-sulfo-higher fatty acid-lower alcohol ester and/or -amide, 10 to 50% of builder(s) for such alpha-sulfo-fatty acid ester and/or -amide, 5 to 40% of bentonite, and 10 to 30% of water, which water includes water removable from any hydrate components of such detergent laundry bar when said bar is subjected to heating at 105° C. for two hours. Preferably the detergent laundry bar comprises 25 to 30% of sodium alpha-sulfo-higher fatty acid-lower alcohol ester and/or -amide in which the lower alcohol is of 1 to 2 carbon atoms and the amide is a primary amide, a N-mono-lower alkyl secondary amide or a N,N-di-lower alkyl tertiary amide, with the lower alkyl(s) being of 1 to 2 carbon atoms, 8 to 20% of sodium tripolyphosphate, 5 to 20% of sodium carbonate, 0 to 5% of sodium silicate, 10 to 20% of bentonite, 0 to 20% of talc, 0 to 20% of calcium carbonate and 18 to 25% of water, and is plodded. Also within the invention are processes for manufacturing a detergent laundry bar of the invention and for converting an aqueous solution or solution/dispersion of the alpha-sulfo-fatty acid ester and/or amide detergent to solid or semi-solid form, using bentonite, and such solid or semi-solid detergent-bentonite products, which are useful forms of the detergent, made without drying.

The closest prior art known to applicants includes disclosures of various synthetic organic detergents, such as sodium alkyl sulfate and sodium alkylbenzene sulfonate, as the primary detergents in built detergent laundry bars which could contain adjuvants, such as clays, including bentonite. The manufacture of alpha-sulfo-higher fatty acid-lower alcohol esters and/or -amides is described in detail in Volume 55 of the Journal of the American Oil Chemists' Society, at pages 549–557, and at page 557 such materials are taught to be components of detergent compositions and soap-detergent bars. Granular detergent compositions containing alpha-sulfo-higher fatty acid-lower alcohol esters are described in Japanese Pat. Nos. 59020395 and 59221394. Belgian Pat. Nos. 638,341 and 648,340 desdribe soap-detergent bars containing such an alpha-sulfo-fatty acid ester as a detersive component. However, none of the references anticipates or makes obvious the subject matter of the present invention, built detergent laundry bars based on such alpha-sulfo-fatty acid esters and/or amides, bentonite and builder.

The alpha-sulfo-higher fatty acid-lower alcohol ester and/or amide of this invention is preferably employed as water soluble salt(s), such as sodium salt(s). However, other alkali metal salts, such as that of potassium, may also be utilized, as may be suitable ammonium, magnesium, calcium and lower alkanolamine salts, e.g., ethanolamine salts.

The alpha-sulfo-higher fatty acid esters useful in this invention are of the formula

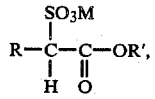

wherein R is higher fatty alkyl or alkenyl and R′ is lower alkyl. R will normally be of 6 to 18 carbon atoms, so that the higher fatty acid moiety, of which it is a part, will be of 8 to 20 carbon atoms. R′ will normally be of 1 to 4 carbon atoms but preferably will be of 1 to 3 carbon atoms, more preferably of 1 to 2 carbon atoms, and most preferably will be methyl. As was indicated before, M can be any of various suitable cations but will preferably be sodium. It is noted that in the alpha-sulfo-fatty acid esters employed in making the detergent laundry bars of this invention the salt is of the sulfonic acid moiety and the ester is of the carboxylic acid moiety of the alpha-sulfo-fatty acid.

The alpha-sulfo-higher fatty amides of the invention are of the formula

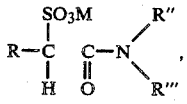

wherein R″ and R‴ are hydrogen or alkyl of 1 to 4 carbon atoms, preferably hydrogen or alkyl of 1 to 3 carbon atoms and more preferably hydrogen or alkyl of 1 or 2 carbon atoms. R and M are the same as described for the ester formula previously given.

The higher fatty acids from which the alpha-sulfo-higher fatty acid-lower alcohol ester and/or amide is-/are made are naturally occurring materials and can be produced by hydrolysis or other suitable reactions of the triglycerides (fats and oils). Unlike some petroleum-derived alkyl and alkenyl moieties, the fatty alkyl fatty alkenyl and fatty acid chains of the principal detergents of the present compositions are readily biodegradable. Among sources of fatty acids useful for the manufacture of the present principal detergents are coconut oil, tallow, palm kernel oil, palm oil and palm stearin, but other oils capable of yielding fatty hydrocarbyl or fatty acid moieties of the types described may be substituted, at least in part. If desired, such oils may be hardened (hydrogenated) beforehand or the fatty acids may be hardened to increase saturation. The fatty acids and the fatty acid moieties of the oils and/or fats from which they are obtained are of carbon atoms contents in the range of 8 to 20 and such fatty acids may include mixtures of fatty acids in different proportions over such range. In some cases narrower cuts of fatty acids may be employed, such as those of progressively narrower carbon contents in the ranges of 10 to 20, 12 to 18 and 12 to 15, or of average numbers of carbon atoms in one of such ranges. Sometimes a particularly narrow cut, e.g., lauric acid, myristic acid, or palmitic acid, may be preferred for best use characteristics of the detergent laundry bar containing the methyl ester of alpha-sulfo-higher fatty acid and/or the corresponding amide wherein R″ and R‴ are hydrogen and/or alkyl of 1 or 2 carbon atoms.

The alpha-sulfo-higher fatty acid ester and/or amide employed, which may hereafter be referred to as alpha-sulfo-fatty acid derivative (or ASFA derivative), is normally initially in the form of an aqueous solution or a solution/dispersion (in which latter form some detergent or other material may be present as a solid, usually as fine particles). Preferably the sulfo-acid ester and/or amide detergent starting material will be in an aqueous solution of its sodium salt, with the concentration for such solution and for any solution/dispersion being such that the detergent constitutes a substantial proportion, preferably a major proportion thereof. The proportions of the sulfo-acid ester and/or amide detergent and water in the solution or solution/dispersion will usually be 1 part of detergent to 0.2 to 6 parts of water, preferably 1 part to 0.3 to 4 parts and more preferably, 1 part to 0.5 to 2 parts. Such ratios correspond to ranges of 14 to 83% of detergent, 20 to 77% and 33 to 67%. It appears that a highly preferably concentration is about 55% and a highly preferred range is 45 to 65% detergent solids in aqueous preparation.

Because the aqueous solutions or solution-dispersions of the principal detergent, alpha-sulfo-higher fatty acid-methyl ester and or alpha-sulfo-higher fatty acid amide, wherein R″ and R‴ are hydrogen and/or alkyl(s) of 1 to 2 carbon atoms, do not process well in equipment normally employed for manufacturing soap and/or detergent bars (amalgamators, mills, plodders, extruders, cutters and presses) and do not make a bar of satisfactory hardness, bentonite is an essential component of the invented products, and when it is blended with the solution or dispersion of the alpha-sulfo-ester and/or amide detergent, it forms a solid or semi-solid mass (depending on moisture content of the detergent solution or dispersion, which, when amalgamated with other detergent laundry bar constituents, milled, plodded and pressed, significantly improves the processability of the detergent laundry bar composition. The bentonite employed may be any suitable bentonite but usually will be a swelling bentonite. It will normally be utilized in powdered form, with all or substantially all (over 95%) passing through a No. 200 sieve, U.S. Series, and sometimes it may be even more preferable to have the bentonite more finely divided, so that a major proportion, or even 99% passes through a No. 325 sieve, too. While it is preferred to employ swelling bentonite of the type known as Wyoming bentonite, having swelling capacities of at least 5 ml. per 2 g., e.g., 5 to 50 ml./g., in water, other bentonites may also be utilized, including those mined in Canada, Italy, Spain, U.S.S.R. and in states of the United States other than Wyoming (principally Idaho, Mississippi and Texas). The bentonites preferably employed are sodium or potassium bentonites and are mined as such. However, bentonites of low or neglible swelling capacities may be converted or activated to increase such capacity by treatment with alkaline materials, such as aqueous sodium carbonate solution, in a manner known in the art. Mixtures of swelling and non-swelling bentonites may be employed but it is considered that the more non-swelling bentonite that is present the less effective the fabric softening activity of the product and the more limited the binding, hardening and processing-improving properties of the bentonite. Among various suppliers of satisfactory swelling bentonites are American Colloid Corporation and Georgia Kaolin Company. A product of Georgia Kaolin Company that has been found to be satisfactory is their Mineral Colloid No. 101, which may be employed alone and/or mixed with their GK-129 clay. American Colloid Corporation supplies a bentonite clay designated AEG 325, which may be employed alone and/or with their Kaolin No. 6 tile clay. In Italy a suitable activated clay is sold as Laviosa AGB and in the Philippines a bentonite clay sold under the tradename Filgel has been found to be useful in the practice of this invention.

Various water soluble builder salts for the alpha-sulfo-fatty acid derivative detergents of this invention, usually in the forms of their sodium salts, may be incorporated in the invented laundry bars. Of these the most important are the phosphates, particularly the polyphosphates, such as sodium tripolyphosphate and sodium pyrophosphate. Sodium orthophosphate may be employed, usually in minor proportion with respect to the polyphosphate(s). Other water soluble builder salts, of the chelating or precipitating types, inorganic and organic, may also be used, such as sodium carbonate, sodium silicate, borax, sodium bicarbonate, and sodium sesquicarbonate. Other builders, including organic builders, such as trisodium nitrilotriacetate (NTA), polyacrylic acid or its salts, e.g., sodium polyacrylate, sodium citrate and sodium polyacetal carboxylate, may be used, as may be other water soluble salts of the corresponding acids.

In addition to the water soluble builders, some water insoluble builders may also be employed, such as detergent building, calcium ion exchanging zeolites, including hydrated zeolites A, X and Y, e.g., Zeolite 4A containing about 20% of water of hydration. Such materials also may act as bodying agents and can improve processability, but while such other desirable properties can be of some importance, herein the zeolites will be considered as builders, and the amounts thereof present will be included in the proportions specified for builders.

Various mixtures of builders may be employed to make the laundry bars of this invention but it is preferable that the primary builder be pentasodium tripolyphosphate, more preferably hydrated and high (over 50%) in type I crystal form. It has been found that such hydrated polyphosphate, which will normally be at least partially hydrated during working in with the other detergent laundry bar components, contributes, with the bentonite, to the improvement of the ease of working, strength and uniform extrusion of the present laundry detergent bars. Sodium carbonate has bodying properties too, as does borax.

Water insoluble particulate material components of the present bars, which are useful as bodying agents and are referred to herein by that title, although they may also perform other functions in the bars, are not considered to be essential components of the present compositions but they can contribute to the formation of a firm, yet processable laundry bar, and can help to regulate the release of detergent from the bar during use. While any of many insoluble materials, usually inorganic and mineral, may be employed, such as clays, talc, calcium silicate, magnesium silicate, calcium sulfate, silica, calcium phosphate and calcium carbonate, the most effective of such materials, as bodying agents, are calcium carbonate and talc. However, due to the action of the bentonite other bodying agents are not necessary. Talc, a natural hydrous magnesium silicate, may be employed because, in conjunction with the other components of the bar, it is especially useful for promoting processing ease, improving the feel of the laundry bar, helping to improve its storage characteristics and making a better foam or lather. Talc contributes lubricity to the present compositions, which aids in processing and desirably increases the "slip" of the product. Calcium carbonate may be present too, but it does not possess the bodying activity of the bentonite in the present detergent laundry bars.

Sodium sulfate may also be present in the invented compositions, as a filler and bodying agent, in proportion in the range of 0 to 30%, preferably 2 to 20%, if it is used.

Various adjuvants may be employed in the present detergent laundry bars for their individual desirable effects. Among such adjuvants are: foam stabilizers, such as higher fatty acid lower alkanolamides, e.g., lauric myristic diethanolamide, coco monoethanolamide and coco diethanolamide; binders, such as starches and modified starches; plasticizers, such as higher fatty acids and alcohols, e.g., lauric acid, myristic acid, cetyl alcohol, lauryl alcohol; hardening agents, e.g., glycerol; colorants, such as dyes and pigments, e.g., Polar Brilliant Blue dye and ultramarine blue pigment; fluorescent brighteners, such as stilbene brighteners; whitening agents, such as titanium dioxide (anatase); antioxidants, e.g., butylated hydroxyl toluene, benzohydroxytoluene; perfumes; anti-redeposition agents, e.g., sodium carboxymethyl cellulose (which also may have binding properties); buffering agents, especially complexing acids, e.g., citric acid, tartaric acid, and boric acid, and mixtures thereof; enzymes, e.g., protease, amylase; abrasives, e.g., pumice powder; bactericides; fungicides; and solvents.

In addition to the above components water will be present in the laundry bar. Normally sufficient water will be available from the composition components, as supplied, especially from the alpha-sulfo-fatty acid derivative solution or suspension. However, if anhydrous detergent is employed or if the components do not contain sufficient water to plasticize the composition satisfactorily for processing, and/or to have enough water in the final bar, water may be added. While it is preferred to employ deionized water, tap water or city water may be utilized, preferably with the hardness content thereof being no more than 200 parts per million, as calcium carbonate, and more preferably with such hardness being less than 100 or 50 p.p.m. The water serves as a mutual solvent and plasticizing agent for various components of the detergent bar and facilitates hydration of some of the hydratable materials which may be present, such as sodium polyphosphate, sodium pyrophosphate, sodium carbonate, sodium sulfate, bentonite and starch (when present). In conjunction with the binders, detergents, builders, bodying agents and/or hydratable salts present, plus some adjuvants, the water tends to facilitate processing, such as milling and plodding, and helps to maintain the detergent bar sufficiently strong so that it will resist cracking and breakage on shipment after manufacture and storage. Higher fatty acids and higher fatty alcohols, if present, may inhibit evaporation of moisture from the laundry bar, thereby helping to maintain the bar in stronger condition on storage. Fatty alkanolamides, when present, may also have such an effect.

The proportions of the various components in the final detergent composition are approximately the same as those in the mixture of materials being formulated (usually in an amalgamator) for milling and plodding because relatively little moisture is lost in such operations. Normally the moisture loss will be between 0.5and 3%, and most of the time the loss will be between 1 and 2.5%, e.g., 2%. If it appears during the mixing or subsequent operations that the composition is not sufficiently plasticized, due to low water content or removal of free water by gelation and hydration, additional water may be employed, which is usually added to the amalgamator, sigma-type mixer or other suitable mixing or blending device, with the various other components of the detergent laundry bar.

The percentage of sodium alpha-sulfo-higher fatty acid ester and/or amide salt(s) detergent in the bar will be a detersive proportion, usually 10 to 40%, preferably 20 to 35%, and more preferably 25 to 30%. Usually no other detergent will be present but sometimes up to 5 or 10% of an auxiliary detergent may be employed, such as sodium higher fatty alcohol sulfate, e.g., sodium coco alcohol sulfate or sodium higher fatty alcohol ethoxylate sulfate, of three to twenty ethylene oxide groups per mole. The bentonite content will usually be in the range of 5 to 40%, preferably being 10 to 30%, more preferably being 10 to 20%, and most preferably being 13 to 17%, e.g., 15% or about 15%. The proportion of bentonite will be a bodying proportion, but sometimes an additional bodying agent may also be present. The total percentage of such supplemental bodying agent(s) will usually be 0 to 30%, preferably 5 to 20%, and such supplementing agent will often preferably be talc, which contributes other desirable properties to the bar. The builder content will normally be in the range of 10 to 50%, preferably 15 to 35%, more preferably 20 to 30%, e.g., about 22%, and it will often be preferred that the builder be inorganic water soluble salt, such as a mixture of sodium tripolyphosphate and sodium carbonate, with sodium silicate, usually of $Na_2O$: $SiO_2$=1:2.4, being optional. The range of water content of the bar, which includes water removable from any hydrate components when the bar is subjected to heating at 105° C. for two hours, following a normal moisture analysis procedure, will normally be 10 to 30%, preferably 15 to 28%, more preferably 18 or 20 to 25%, e.g., 23%, or about 23%. With respect to individual builders and bodying agents it may be preferred that the builders include 5 to 35% of sodium tripolyphosphate, 0 to 25% of sodium carbonate and 0 to 10% of sodium silicate, more preferably 8 to 20%, 5 to 20%, and 0 to 5%, respectively, and still more preferably, 10 to 15%, 8 to 12% and 0 to 3%, respectively, e.g., about 12% of sodium tripolyphosphate, about 10% of sodium carbonate and no sodium silicate. The supplementing bodying agent contents, preferably water insoluble powder(s), will preferably be 0 to 20% of calcium carbonate and 0 to 20% of talc, more preferably 0 to 15% of calcium carbonate and 5 to 15% of talc, e.g., about 0% of calcium carbonate and about 11% of talc.

Adjuvant content will usually be limited to 5% and preferably will be limited to 3%. Thus, the proportion of adjuvants present may be in the range of 0.5 to 3 or 5%, e.g., about 1 to 2%.

The invented detergent laundry bars can be processed with available equipment of types used for manufacturing soap and detergent bar products. Initially, a heavy duty amalgamator or mixer, such as one equipped with sigma-type blades, or one equipped with counter-rotating paddle type agitators, is used to mix the various components, many of which are powdered but some of which are in liquid state, as aqueous solution and/or dispersions (the alpha-sulfo-higher fatty acid methyl ester, sodium salt, or the alpha-sulfo-higher fatty acid amide of ammonia, sodium salt, for example). It is a special feature of this invention that the principal alpha-sulfo-higher fatty acid derivative salt detergent can be used as an aqueous solution because preliminary mixing with bentonite produces a solid or semi-solid mass, which can be easily amalgamated with other components of the product, and subsequently can be milled and plodded. Without the bentonite, even when another insoluble powder, such as calcium carbonate, is employed, the detergent is too fluid and the result is poor processing and production of a soft and tacky bar.

The order of addition of the other components of the laundry bar to the detergent-bentonite solid is not considered to be important because the bentonite in the solid acts to inhibit complete or premature hydration of the phosphate (and any other hydratable components which desirably hydrate during working of the composition) and any resulting excessive lumping which could occur in the mixing process. If dried detergent is available it can be used and the bentonite will contribute to the product fabric softening, bodying and good processing characteristics. Also, such a product will not be tacky or excessively soft. The usual mixing time is from 2 to 15 minutes but it can take from one minute to an hour. The mixed product will desirably be in separate solid form (or a divisible mass) at about room temperature and will be charged, preferably by means of a multi-worm transfer conveyor (preferably equipped with cooling means), to a multi-rolled mill, such as a five-roll Lehmann mill of the soap mill type. The mill will be equipped with means for heating and cooling, and normally cooling will be employed to maintain the temperature of the ribbons from the mill within the range of about 30° to 40° or 45° C. Various ribbon and chip thicknesses may be employed but usually such thicknesses will be in the range of 0.1 to 1 mm., preferably 0.2 to 0.4 or 0.5 mm. However, other thicknesses may be milled, too, depending on particular formulations, so long as the composition is satisfactorily homogenized on the mill and providing that any coarse particles that may be present are pulverized so that the finished product is not objectionably gritty.

The milled chips or milled material in other form is then conveyed to a double stage vacuum plodder, operating under a suitable vacuum, e.g., 600 to 740 millimeters of mercury vacuum, in which any entrapped air is evacuated. In some instances milling may be omitted and the amalgamator mix may be plodded directly. The mass of laundry detergent composition is worked in the plodder and is extruded from it as a bar. The plodder is equipped with a heated nozzle which softens the composition immediately prior to extrusion, allowing the production of a uniform and homogeneous bar. Such bar may be cut to length and impressed with a product brand name by means of a combination of rotary cutter and imprinter, or it may be cut to lengths, called blanks, and may be stamped to shape in a press. Before pressing, the blanks may be cooled in a cooling tunnel. If not to be pressed, the cut lengths are cooled before wrapping. In either case the cooled bars are automatically wrapped, cased and sent to storage, prior to shipping. Following another manufacturing method, the detergent composition is crutched, spray dried and plodded and/or pressed to bar or cake form.

The detergent laundry bars made in accordance with this invention have acceptable washing and foaming properties for detergent laundry bars, are good curd dispersants, are of satisfactory hardness, and are resistant to breakage. They are also better than laundry bars based on other detergents, such as sodium higher fatty alcohol sulfate and sodium higher alkylbenzene sulfonate, in storage properties and biodegradability, respectively. The various components of the laundry bars interact and contribute to the final desirable properties of the products in several ways, to produce the desired products, which are effective cleaning agents and yet are very mild to the hands.

The following examples are given to illustrate the invention but are not to be considered as limiting it. Unless otherwise indicated, in the specification and in the claims all parts and proportions are by weight and all temperatures are in ° C.

EXAMPLE 1

Twenty-eight parts of alpha-sulfo-higher ($C_{8-20}$) fatty acid- methyl ester, sodium salt (hereinafter referred to as ASFE), in which the higher fatty acid is coco fatty acid (in a 55% solids content aqueous solution) and 15 parts of finely divided (through No. 200 sieve, U.S. Sieve Series) bentonite (FILGEL, Philippines) are blended together in a conventional soap or detergent amalgamator (or similar sigma blade mixer)and mixing is continued until a solid product is formed, which breaks apart and recombines repeatedly during mixing. Total admixing and mixing time is about 15 minutes. The product is milled (or otherwise converted) to thin ribbons (or other pieces) of detergent-bentonite composition, useful for the manufacture of detergent laundry bars, but is often preferably mixed with other components of the final desired detergent laundry bar composition in the same amalgamator immediately after solidification of the detergent solution by means of the swelling bentonite. The described mixings are carried out at room temperature, about 20° to 25° C., and the heat of mixing can raise the product temperature 1° to 3° C.

A similar semi-solid product is made when the ASFE is present in a 30% aqueous solution but in such case one will often employ less of the ASFE in the detergent laundry bar (because of the greater water content that would be present with the ASFE) and if more ASFE is desired in the final product it is added as a dry powder or a more concentrated dispersion is employed, so the ASFE: water ratio is about the same as given above.

Although usually the solid product made will be used within a short time after manufacture, it may be stored for subsequent use, too. In such case, it will often be size-reduced to pellet or other suitable form, as in an extruder equipped with a rotary cut-off knife. The product is a good source of detergent and bentonite, especially suitable for incorporation in fabric softening detergent compositions.

EXAMPLE 2

| Components | Percentages |
|---|---|
| Sodium salt of alpha-sulfo-higher ($C_{12-15}$) fatty acid-methyl ester - bentonite solid[1] | 65.9 |
| Sodium tripolyphosphate[2] | 12.0 |
| Sodium carbonate, anhydrous | 10.0 |
| Talc, powdered (through No. 200 sieve, U.S. Sieve Series) | 10.7 |
| Antioxidant (butylated hydroxyl toluene) | 0.1 |
| Sodium carboxymethyl cellulose | 0.5 |
| Pigment (white anatase titanium dioxide, finely powdered) | 0.3 |
| Optical brightener (stilbene type) | 0.2 |
| Dye, blue | 0.03 |
| Perfume | 0.3 |
| Water deionized (to compensate for processing losses) | 2.0 |
| water loss in processing | 2.0 |
| | 100.0 |

[1]From Example 1.
[2]High in Phase I content, over 50% Phase I.

Detergent laundry bars of the above formula are made by a process which includes the steps of mixing, milling, plodding, cutting to lengths and (optionally) pressing to shape. Mixing is effected in a conventional soap or detergent amalgamator. The order or addition of the other components to the detergent-water-bentonite starting material is not critical but it is considered to be desirable that the sodium tripolyphosphate, which is hydratable, be added near the end of the mixing, shortly before the milling or other working. This is done to promote uniformity of hydration of the polyphosphate in homogeneous contact with other bar components, which helps to strengthen the final bar. The tying up of the water in the ASFE-bentonite-water starting material also helps to prevent premature hydration of the polyphosphate and other hydratable builders. In the mixing operation described, the various liquid components of the formula are first added to the detergent-bentonite materials in the mixer, followed by the particulate or powdered components. Mixing takes only a brief time, about five minutes, which is intentional so as to inhibit complete hydration of the polyphosphate, but longer mixing periods are allowable, especially in view of the protective action of the bentonite. The mix made is in the form of a plurality of solid lumps, which are separable and which break apart during the mixing operation. The contents of the mixer are fed by a multi-worm conveyor to a five-roll mill of the Lehmann type, wherein the solid mix lumps are converted to ribbon and chip form. The multi-worm transfer conveyor is equipped with cooling means so as to prevent excessive sticking of the mixture to the conveyor parts.

The mill, which is also equipped with cooling means, operates at such a temperature that the final chip is at a suitable temperature, in the range of about 35° to 42° C., but in some instances higher or lower temperatures may be employed. The chip thickness is maintained in the range of 0.2 to 0.4 mm. The milled chips are then fed to a double stage vacuum plodder, which operates at a vacuum of about 700 mm. of mercury, to remove any entrapped air and to work the composition and extrude it as a bar through a heated nozzle, wherein the composition is heated sufficiently to facilitate extrusion as a homogeneous bar. The bar is then cooled to a suitable pressing temperature, preferably in the range of 20° to 30° C., and is pressed to final bar or cake shape, following which it is automatically wrapped, cased and sent to storage, for subsequent shipment and sale to the ultimate consumer. Alternatively, instead of being pressed to shape, the bars may be cut or essentially simultaneously cut and "printed" with a company name or other indicia, in which case the mentioned cooling may be effected after cutting and/or "imprinting".

The milling and plodding proceed well, with power requirements being substantially like those for manufacturing soap bars, and the bars made appear to be homogeneous. The bars are evaluated by expert evaluators and by consumers and are found to be of satisfactory utilitarian and aesthetic characteristics. Particularly, the bars are found to foam, refoam, and persist in foam satisfactorily, to feel good to the hands of the user, to clean well, to be sufficiently hard, not to be consumed too quickly, to disperse fatty curd in the wash water, and last, but not least, to be mild to the hands. Also, it is noted that the invented bars that are subjected to handling like that normally encountered in commercial distribution do not crack, break, powder or disintegrate so as to be unacceptable.

The foaming tests run to evaluate the invented bars accurately reflect use conditions of the present laundry bars. In actual use the items to be washed are wet and then are rubbed, on a washboard, with the laundry bar. After rubbing enough detergent composition into an item to be cleaned the item is rubbed on the washboard or other hard surface until dirt, soil or stain is removed. It is then rinsed and sometimes is re-treated. The washboard may be in a sink, pan, tub, pail, drum or other suitable container which will hold the wash water. After washing the first item of laundry, additional items may be wet in the wash water and then rubbed on the washboard, sometimes with the application of additional detergent composition from the laundry bar, and sometimes without such application. It is important to the consumer, and therefore it is important to the manufacturer, that in this second washing and in any further washings with the same wash water, the wash water will still generate a substantial amount of foam, as the laundry is moved through it, while the laundry is being rubbed on the washboard.

In a test devised to yield data corresponding to that from such hand washing processes, a pair of counter-oscillating washing machine-type agitators, but on a reduced scale, is mounted vertically and spaced apart, so as to agitate water in a plastic container that measures 34.3 cm. long×29.2 cm. wide×13.3 cm. high. A piece of towelling, such as a nubby face cloth, with holes cut in it to allow it to fit over vertical drive shafts for the agitators, rests on the tops of the agitators, each of which is of a generally flat truncated cone shape, with three equidistant vertical ribs. As the agitators move, the towelling twists and untwists, simulating the motions in the wash water of laundry being scrubbed. To start the test, three liters of a solution of the laundry bar being tested (or of the components of such a bar) are made, with the composition concentration being 2.5 g./l., and with the wash water used being of 300 p.p.m. hardness (mixed calcium and magnesium hardness, as $CaCO_3$). The foam height is measured after five minutes agitation, after which the water is allowed to rest for two minutes, with the height then again being read, and then agitation is resumed for another five minutes, and a third foam height reading is taken. By such tests it has been established that the foam height after refoaming is an excellent indication of the overall foaming capability of a product, including its initial and "after rest" foaming too. The product of this example, when tested as described, exhibits a refoaming height of about 5 cm., which is considered to be good.

EXAMPLE 3

In variations of Example 1 the FILGEL bentonite is replaced by other swelling bentonites, Mineral Colloid No. 101, AEG 325, and Laviosa AGB, all of swelling capacities over 5ml./g. and the solution of ASFE detergent is mixed with the fifteen parts of the different bentonites. The products resulting are solid intermediates, useful for the manufacture of the described detergent laundry bars. The bars from them, of formulas like that of Example 2 except for the bentonite, are of acceptable washing, foaming, softening and mildness characteristics, comparable to those described for the product of Example 2.

In variations of this example the proportion of ASFE to bentonite is varied so that 10 to 40 parts of ASFE (solids basis) are mixed with 5 to 40 parts of bentonite, with the proportion of ASFE to bentonite being in the range of 1:1 to 4:1 and with the ASFE being in an aqueous solution/dispersion containing 1 part ASFE per 0.3 to 4 parts of water. Usually, the ethoxylate sulfate solution used is of 45 to 65% solids, with the balance being water. The products made are solids (sometimes semi-solids) that are suitable for being converted to detergent laundry bars of this invention.

In other modifications of Examples 1 and 2, the ASFE is varied to be sodium salt of a methyl ester of a higher fatty acid of 10 to 18 (or 12 to 16) carbon atoms, such as one derived from tallow and/or palm kernel oil. The Example 1 type products made are solids, useful for the manufacture of acceptable detergent laundry bars of the type described in Example 2 and are satisfactory in detersive, foaming, curd dispersing, storage stability, and mildness characteristics. Similarly, satisfactory intermediate products and final detergent laundry bars are obtainable when the ASFE is a potassium salt or one of triethanolamine, and the lower alcohol is ethanol instead of methanol.

EXAMPLE 4

The experiments reported in Examples 1–3 are repeated but using alpha-sulfo-$C_{8-20}$ fatty acid ethyl ester, sodium salt; a mixture of 1 part each of ASFE methyl and ethyl esters, as sodium salts; alpha-sulfo-coconut oil fatty acids primary amide, sodium salt; and a mixture of 3 parts of alpha-sulfo-myristic acid-N-methyl amide, sodium salt, with 1 part of the corresponding N,N-diethyl amide, potassium salt; in place of the principal detergents of such examples. Products of essentially the same satisfactory intermediate and final detergent laundry bar characteristics result.

EXAMPLE 5 (comparative)

When the procedure of Example 1 is modified by substituting calcium carbonate powder for bentonite the product obtained remains fluid and is unacceptable for making detergent laundry bars by amalgamating with other constituents of such bars. When it is attempted to mill and plod compositions of the formula given in Example 2, with the substitution of calcium carbonate for the bentonite, the milled, plodded and extruded material resulting is too soft to be acceptable for pressing or other conversion to final bar or cake form. Similar negative results obtain when other water insoluble inorgnic fillers are used instead of the bentonite, and similar results are obtained when the principal detergents of Example 4 replace those of Examples 1 and 2.

EXAMPLE 6

When the percentages of the various components given in Examples 1–4 are varied ±10% and ±25%, while being maintained within the ranges described in the specification, useful bentonite-ASFE-water compositions, corresponding bentonite-ASFA amide-water compositions and resulting detergent laundry bars are obtainable, which are of satisfactory processability, detergency, foaming properties, curd dispersion, mildness and hardness. Such is also the case when 3% of sodium silicate is present in the formulas of Examples 2–4 replacing 3% of sodium carbonate. When talc is removed from the formulas, being replaced by bentonite or calcium carbonate, its lubricity is lost but the product is satisfactory. When calcium carbonate is present (5%, replacing 5 % of talc) useful products are obtainable, but are of lesser foaming power and lowered lubricity. When sodium carbonate is omitted, being replaced by sodium tripolyphosphate, the final products are also acceptable detergent bars, as are the products resulting when up to ⅓ of the talc is replaced by sodium sulfate.

The invention has been described with respect to examples and illustrations thereof but is not to be limited to these because it is evident that one of skill in the art, with the present specification before him, will be able to utilize substitutes and equivalents without departing from the invention.

What is claimed is:

1. A built synthetic organic detergent laundry bar consisting essentially of 10 to 40% of water soluble salt selected from the group consisting of alpha-sulfo-higher fatty acid-lower alkyl amide, and mixtures thereof (ASFA derivatives), 10 to 50% of builder(s) for such ASFA derivative(s), 5 to 40% of bentonite, and 10 to 30% of water, which water includes water removable from any hydrate components of such detergent laundry bar when said bar is subjected to heating at 105° C. for two hours.

2. A built synthetic organic detergent milled and plodded laundry bar according to claim 1 wherein the water soluble salt of the ASFA derivative is a sodium salt, the principal detergent of the bar is selected from the group consisting of

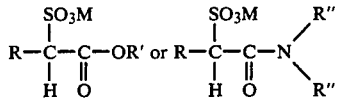

wherein R is alkyl or alkenyl of 6 to 18 carbon atoms, R′ is alkyl of 1 to 4 carbon atoms, and R″ and R‴ are hydrogen or alkyl of 1 to 2 carbon atoms, the builder for the ASFA derivative is water soluble inorganic builder salt or a mixture of such salts, and the bentonite is present in such a percentage that it contributes bodying properties to the laundry bar and softens materials washed with it.

3. A laundry bar according to claim 2 consisting essentially of 20 to 35% of a sodium alpha-sulfo-higher fatty acid-lower alcohol compound selected from the group consisting of sodium alpha-sulfo-higher fatty acid-lower alcohol ester, in which the lower alcohol is of 1 to 3 carbon atoms, corresponding sodium alpha-sulfo-higher fatty acid-lower alkyl amide, and mixtures thereof, 5 to 35% of sodium tripolyphosphate, 0 to 25% of sodium carbonate, 0 to 10% of sodium silicate, 10 to 30% of bentonite and 15 to 28% of water.

4. A laundry bar according to claim 3 consisting essentially of 25 to 30% of sodium alpha-sulfo-higher fatty acid-lower alcohol ester in which the lower alcohol is of 1 to 2 carbon atoms, 8 to 20% of sodium tripolyphosphate, 5 to 20% of sodium carbonate, 0 to 5% of sodium silicate, 10 to 20% of bentonite, 0 to 20% of talc, 0 to 20% of calcium carbonate and 18 to 25% of water, which bar is plodded.

5. A laundry bar according to claim 4 consisting essentially of 25 to 30% of sodium alpha-sulfo-higher fatty acid-methyl ester, 10 to 15% of sodium tripolyphosphate, 13 to 17% of bentonite, 8 to 12% of sodium carbonate, 0 to 3% of sodium silicate, 5 to 15% of talc, 0 to 15% of calcium carbonate and 20 to 25% of water, which bar is milled and plodded.

6. A laundry bar according to claim 5 consisting essentially of about 28% of sodium alpha-sulfo-higher fatty acid-methyl ester wherein the higher fatty acid moiety is a mixture of fatty acids in the range of 8 to 20 carbon atoms, obtained from vegetable oil(s), about 12% of sodium tripolyphosphate, about 15% of bentonite, about 10% of sodium carbonate, about 0% of sodium silicate, about 11% of talc, about 0% of calcium carbonate, and about 23% of water, which bar is milled, plodded and pressed.

7. A laundry bar according to claim 3 consisting essentially of sodium alpha-sulfo-higher fatty acid amide, of which the N is unsubstituted or lower alkyl substitute, 8 to 20% of sodium tripolyphosphate, 5 to 20% of bentonite, 0 to 20% of talc, 0 to 20% of calcium carbonate and 18 to 25% of water, which bar is plodded.

8. A laundry bar according to claim 7 consisting essentially of 25 to 30% of sodium alpha-sulfo-higher fatty acid primary amide, 10 to 15% of sodium tripolyphosphate, 13 to 17% of bentonite, 8 to 12% of sodium carbonate, 0 to 3% of sodium silicate, 5 to 15% of talc, 0 to 15% of calcium carbonate and 20 to 25% of water, which bar is milled and plodded.

9. A laundry bar according to claim 7 consisting essentially of about 28% of sodium alpha-sulfo-higher fatty acid-N-methyl amide wherein the higher fatty acid moiety is a mixture of fatty acids in the range of 8 to 20 carbon atoms, obtained from vegetable oil(s), about 12% of sodium tripolyphosphate, about 15% of bentonite, about 10% of sodium carbonate, about 0% of sodium silicate, about 11% of talc, about 0% of calcium carbonate, and about 23% of water, which bar is milled, plodded and pressed.

10. A process for manufacturing a detergent milled and plodded laundry bar of the composition of claim 1 consisting essentially of mixing together proportions for said composition of water soluble salt of ASFA derivative detergent in aqueous solution or aqueous solution/-dispersion, and bentonite, to convert such solution or solution/dispersion to semi-solid or solid form, mixing such bentonite-ASFA derivative salt - water mixture, in semi-solid or solid form, with the builder(s) for the alpha-sulfo-higher fatty acid ester salt detergent and additional water for processing, if required, with an excess of water being present to compensate for water to be lost in subsequent processing, plodding the mixture, and extruding it in bar form.

11. A process according to claim 10 consisting essentially of mixing together 20 to 35 parts of sodium ASFA derivative in aqueous solution or solution/dispersion containing 1 part of sodium ASFA derivative wherein the higher fatty acid is of 8 to 20 carbon atoms, per 0.3 to 4 parts of water, with 10 to 30 parts of bentonite to produce such mixture in semi-solid or solid form, suitable for subsequent amalgamating, plodding and extruding in bar form to produce a detergent laundry bar.

12. A process according to claim 11 consisting essnetially of mixing together an aqueous solution of about 28 parts of sodium alpha-sulfo-higher fatty acid-lower alcohol ester, in which the higher fatty acid moiety is a mixture of fatty acids having in the range of 8 to 20 carbon atoms, obtained from vegetable oil(s), and the lower alcohol is methanol, and about 23 parts of water, with about 15 parts of bentonite to convert such solution to semi-solid or solid form, mixing such bentonite - sodium alpha-sulfo-higher fatty acid-methyl ester - water mixture, in semi-solid or solid form, with about 12 parts of sodium tripolyphosphate, about 11 parts of talc, and about 10 parts of sodium carbonate, milling and plodding the mixture, extruding it in bar form and cutting the bar to desired lengths.

13. A process for converting an aqueous solution or solution/dispersion of water soluble ASFA derivative to semi-solid or solid form, suitable for amalgamating with other detergent laundry bar components and subsequent milling, plodding and extruding in bar form, to produce a detergent laundry bar, consisting essentially of mixing together 10 to 40 parts of such detergent, in lower alkyl ester or amide form, in aqueous solution or solution/dispersion in 10 to 30 parts of water, with 5 to 40 parts of bentonite, to produce such mixture in semi-solid or solid form, suitable for amalgamating, milling, plodding and extruding in bar form, to produce a detergent laundry bar.

14. A process according to claim 13 wherein the water soluble ASFA derivative detergent is sodium alpha-sulfo-higher fatty acid-methyl ester and the higher fatty acid moiety is a mixture of fatty acids in the range of 8 to 20 carbon atoms, obtained from vegetable oil(s), the sodium alpha-sulfo-higher fatty acid methyl ester is in aqueous solution which contains 45 to 65% of such alpha-sulfo-fatty acid ester and 35 to 55% of water, and the proportion of such alpha-sulfo-fatty acid ester, from the aqueous solution, to bentonite, is in the range of 1:1 to 4:1.

15. A product of the process of claim 13.

16. A product of the process of claim 14.

17. A built synthetic organic detergent laundry bar according to claim 1 which is the product of a process consisting essentially of mixing together proportions for said laundry bar composition of water soluble salt of ASFA derivative detergent in aqueous solution or aqueous solution/dispersion, and bentonite, to convert such solution or solution/dispersion to semi-solid or solid form, mixing such bentonite - ASFA derivative salt detergent - water mixture, in semi-solid or solid form, with the builder(s) for the ASFA derivative detergent salt and additional water for processing, if required, with an excess of water being present to compensate for water to be lost in subsequent processing, plodding the mixture, and extruding it in bar form.

18. A built synthetic organic detergent laundry bar according to claim 3 which is the product of a process comprising mixing together 20 to 35 parts of sodium ASFA derivative detergent in aqueous solution or solution/dispersion containing one part of sodium ASFA derivative detergent wherein the higher fatty acid is of 8 to 20 carbon atoms, per 0.3 to 4 parts of water, with 10 to 30 parts of bentonite, to produce such mixture in semi-solid or solid form, mixing such bentonite - sodium AFSA derivative detergent - water mixture, in semi-solid or solid form, with the builder(s) for the sodium ASFA derivative salt detergent and additional water for processing, with an excess of water being present to compensate for water to be lost in subsequent processing, amalgamating the mixtures, plodding it and extruding it in bar form.

19. A laundry bar according to claim 6 which is a product of the process of mixing together an aqueous solution of about 28 parts of sodium alpha-sulfo-higher fatty acid-lower alcohol, ester, in which the higher fatty acid moiety is a mixture of fatty acids having in the range of 8 to 20 carbon atoms, obtained from vegetable oil(s), and the lower alcohol is methanol, and about 23 parts of water, with about 15 parts of bentonite, to convert such solution to semi-solid or solid form, mixing such bentonite - sodium alpha-sulfo-higher fatty acid-methyl ester - water mixture, in semi-solid or solid form, with about 12 parts of sodium tripolyphoshpate, about 11 parts of talc, and about 10 parts of sodium carbonate, milling and plodding the mixture, extruding it in bar form and cutting the bar to desired lengths.

* * * * *

UNITED STATES PATENT OFFICE

CERTIFICATE OF CORRECTION

PATENT NO. : 4,707,289

DATED : November 17, 1987

INVENTOR(S) : Pallassana N. Ramachandran and Patrizia Barone

It is certified that error appears in the above-identified patent and that said Letters Patent is hereby corrected as shown below:

Column 13, line 56, between "acid-lower" and "alkyl" insert --- alcohol ester, alpha-sulfo-higher fatty acid lower ---; and Column 14, lines 1-6, replace with ---

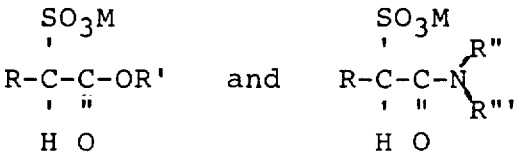

and mixtures thereof, --- .

Signed and Sealed this

Ninth Day of November, 1993

*Attest:*

*Attesting Officer*

BRUCE LEHMAN

*Commissioner of Patents and Trademarks*